US006739755B2

(12) United States Patent
Schreiter

(10) Patent No.: US 6,739,755 B2
(45) Date of Patent: May 25, 2004

(54) LEAK PROOF CLOSURE MECHANISM FOR RESEALABLE BAG

(75) Inventor: Michael E. Schreiter, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 14 days.

(21) Appl. No.: 10/197,124

(22) Filed: Jul. 18, 2002

(65) Prior Publication Data

US 2003/0077009 A1 Apr. 24, 2003

Related U.S. Application Data

(60) Provisional application No. 60/335,465, filed on Oct. 24, 2001.

(51) Int. Cl.[7] ..... B65D 33/16
(52) U.S. Cl. ..... 383/64; 24/400
(58) Field of Search ..... 383/64; 24/399, 24/400

(56) References Cited

U.S. PATENT DOCUMENTS

| | | | | |
|---|---|---|---|---|
| 3,153,269 A | | 10/1964 | Berry | |
| 3,259,951 A | | 7/1966 | Zimmerman | |
| 3,426,396 A | * | 2/1969 | Laguerre | 24/427 |
| 3,713,923 A | * | 1/1973 | Laguerre | 156/66 |
| 3,790,992 A | | 2/1974 | Herz | |
| 4,285,105 A | | 8/1981 | Kirkpatrick | |
| 4,829,641 A | | 5/1989 | Williams | |
| 5,007,142 A | | 4/1991 | Herrington | |
| 5,007,143 A | | 4/1991 | Herrington | |
| 5,020,194 A | | 6/1991 | Herrington et al. | |
| 5,067,208 A | | 11/1991 | Herrington, Jr. et al. | |
| 5,131,121 A | | 7/1992 | Herrington, Jr. et al. | |
| 5,301,395 A | | 4/1994 | Richardson et al. | |
| 5,442,837 A | | 8/1995 | Morgan | |
| 5,664,299 A | | 9/1997 | Porchia et al. | |
| 5,729,876 A | | 3/1998 | Johnson | |
| 5,774,955 A | | 7/1998 | Borchardt et al. | |
| 5,809,621 A | | 9/1998 | McCree et al. | |
| 5,836,056 A | | 11/1998 | Porchia et al. | |

(List continued on next page.)

FOREIGN PATENT DOCUMENTS

| | | | | |
|---|---|---|---|---|
| JP | WO 02/47993 A | | 6/2002 | |
| JP | 2002-177020 | * | 6/2002 | 383/64 |
| WO | WO 02/062672 A | | 8/2002 | |

*Primary Examiner*—Jes F. Pascua
(74) *Attorney, Agent, or Firm*—Tracey D. Beiriger; Joseph D. Kuborn

(57) ABSTRACT

A resealable package includes first and second panel sections joined together to define an enclosed region, first and second opposite side edges, a bottom edge, and a mouth that provides access to the enclosed region. The resealable package also includes a closure mechanism for selectively opening and sealing the mouth. The closure mechanism includes first and second closure profiles, the first closure profile having first and second base strips with first and second interlocking closure members extending from the first and second base strips, respectively, and the second closure profile having third and fourth base strips with third and fourth interlocking closure members extending from the third and fourth base strips, respectively. The first and second interlocking closure members and third and fourth interlocking closure members extend a length from the first, second, third and fourth base strips sufficient for the first and third interlocking closure members and the second and fourth interlocking closure members to selectively engage. The closure mechanism further includes a slider having a plow. The plow comprises a substantially vertical member depending from the top of the slider and a substantially horizontal member that is connected to the substantially vertical member and is disposed between the first and third interlocking closure members and the second and fourth interlocking closure members, respectively.

19 Claims, 12 Drawing Sheets

U.S. PATENT DOCUMENTS

| | | | | |
|---|---|---|---|---|
| 5,839,831 | A | 11/1998 | Mazzocchi | |
| 5,871,281 | A | 2/1999 | Stolmeier et al. | |
| 5,896,627 | A | 4/1999 | Cappel et al. | |
| 5,924,173 | A | 7/1999 | Dobreski et al. | |
| 5,950,285 | A | 9/1999 | Porchia et al. | |
| 5,983,466 | A | 11/1999 | Petkovsek | |
| 6,004,032 | A | 12/1999 | Kapperman et al. | |
| 6,014,795 | A | 1/2000 | McMahon et al. | |
| 6,088,887 | A | 7/2000 | Bois | |
| 6,220,754 | B1 | 4/2001 | Stiglic et al. | |
| 6,231,236 | B1 | 5/2001 | Tilman | |
| 6,247,844 | B1 | 6/2001 | Tomic et al. | |
| 6,257,763 | B1 | 7/2001 | Stolmeier et al. | |
| 6,287,001 | B1 | 9/2001 | Buchman | |
| 6,698,926 | B2 * | 3/2004 | Buchman | 383/64 |

* cited by examiner

LEAK PROOF CLOSURE MECHANISM FOR RESEALABLE BAG

This application claims the benefit of and priority to U.S. Provisional Application Ser. No. 60/335,465 filed on Oct. 24, 2001, under 35 U.S.C. §119(e). The complete disclosure of application No. 60/335,465 is incorporated herein by reference.

FIELD OF THE INVENTION

The present invention relates generally to closure mechanisms for polymer packages, for example, plastic bags. In particular, the present invention relates to leak proof resealable closure mechanisms for resealable bags.

DISCUSSION OF RELATED ART

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Resealable packages typically utilize a closure mechanism that is positioned along the mouth of the package. The closure mechanism often comprises profile elements or closure profiles that engage one another when pressed together. Some types of resealable packages are opened and closed using a slider device. The slider device design includes a separator or plow-type structure at one end that causes the closure mechanism to disengage when the slider device travels in a first direction along the mechanism. The side walls of the slider device are inwardly tapered from one end to the opposite end so that the side walls engage the closure profiles and progressively move them into engagement when the slider device is moved along the closure mechanism in a direction opposite the first direction, thereby closing the closure mechanism. Side seals at each end of the closure mechanism keep the slider device from sliding off the package in either direction.

While the use of a slider is convenient in terms of opening and closing the package, the presence of the separator or plow can cause problems in the sealability of the package. The separator or plow can inhibit full engagement of the closure profiles, leading to the possibility of product escaping from the package. This is a significant concern when the product is a liquid or a small solid that can leak through even the smallest opening in the package. It is therefore desirable to provide a slider and closure mechanism that can be fully sealed to prevent product leakage.

SUMMARY OF THE INVENTION

In an embodiment of the present invention, a closure mechanism is provided including first and second closure profiles, the first closure profile having first and second base strips with first and second interlocking closure members extending from the first and second base strips, respectively, and the second closure profile having third and fourth base strips with third and fourth interlocking closure members extending from the third and fourth base strips, respectively. The first and second interlocking closure members and third and fourth interlocking closure members extend a length from the first, second, third and fourth base strips sufficient for the first and third interlocking closure members and the second and fourth interlocking closure members to selectively engage. The closure mechanism further includes a slider device having first and second walls and a top that define a first cavity for receiving the first and second closure profiles. The slider device is arranged and configured to slide along the first and second closure profiles in a first direction to cause the first and second closure profiles to engage and to slide along the first and second closure profiles in a second direction to cause the first and second closure profiles to disengage. The slider device further comprises a plow. The plow comprises a substantially vertical member depending from the top of the slider and a substantially horizontal member that is connected to the substantially vertical member and is disposed between the first and third interlocking closure members and the second and fourth interlocking closure members, respectively.

In another embodiment of the present invention, a resealable package includes first and second panel sections joined together to define an enclosed region, first and second opposite side edges, a bottom edge, and a mouth that provides access to the enclosed region. The resealable package also includes a closure mechanism for selectively opening and sealing the mouth. The closure mechanism preferably includes structure as previously described herein.

BRIEF DESCRIPTION OF THE DRAWINGS

The various features and benefits of the present invention are apparent in light of the following detailed description and the accompanying drawings, in which.

DETAILED DESCRIPTION OF THE INVENTION

Figure 1:
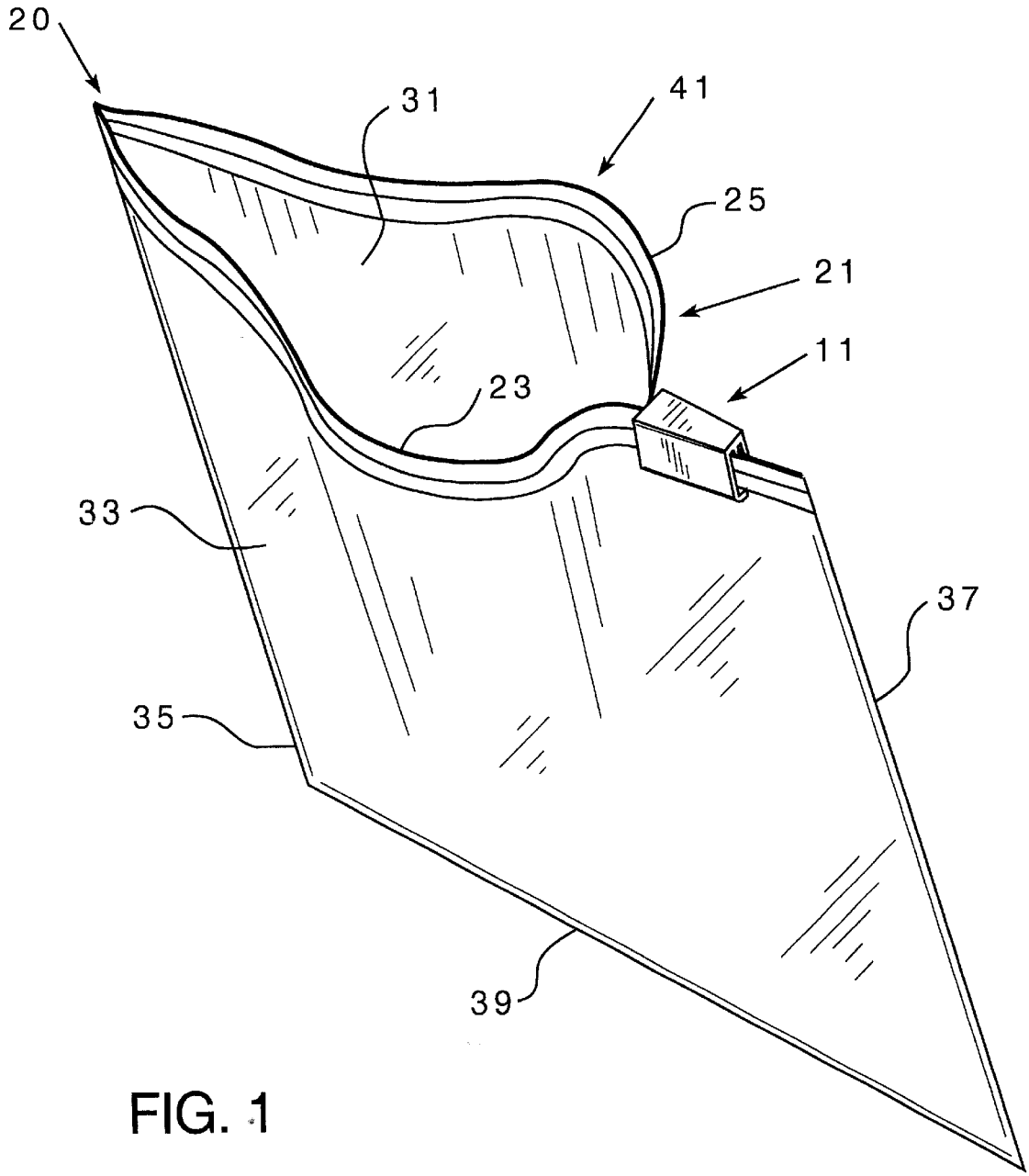
FIG. 1 is a perspective view of a flexible, resealable package in accordance with an embodiment of the present invention.

FIG. 1 illustrates an example resealable flexible package 20 having a closure mechanism 21 with first and second closure profiles 23, 25 and a slider device 11 to open and close the profiles 23, 25.

The flexible package 20 includes first and second opposed panel sections 31, 33 made from a flexible, polymeric film. For some manufacturing applications, the first and second panel sections 31, 33 are heat-sealed together along two edges 35, 37 and meet at a fold line in order to form a three-edged containment section for a product within the interior of the package 20. The fold line comprises the bottom edge 39. Alternatively, two separate panel sections 31, 33 of polymeric film may be used and heat-sealed together along the two edges 35, 37 and at the bottom 39. Access to the interior of the package 20 is provided through a mouth 41. In other implementations of the present invention, the package 20 includes tear strings and/or notches at the mouth 41 to assist with opening the package 20.

Figure 2:
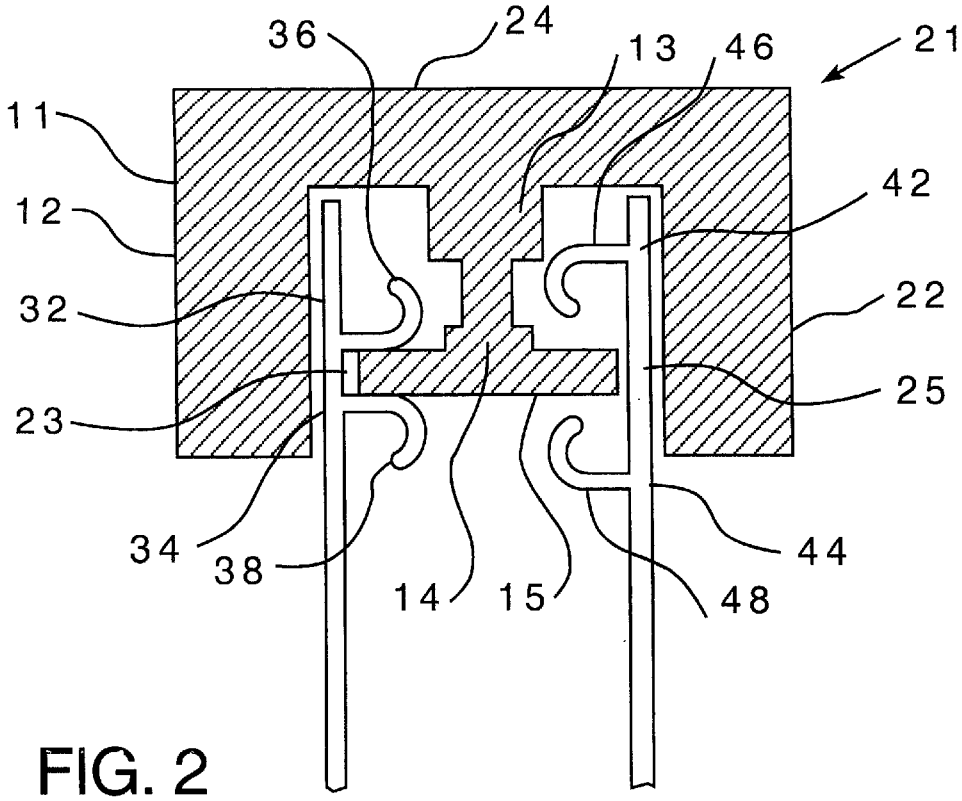
FIG. 2 is a fragmented, cross-sectional view of a closure mechanism in accordance with an embodiment of the present invention, taken along line 2—2 of FIG. 5.
Figure 3:
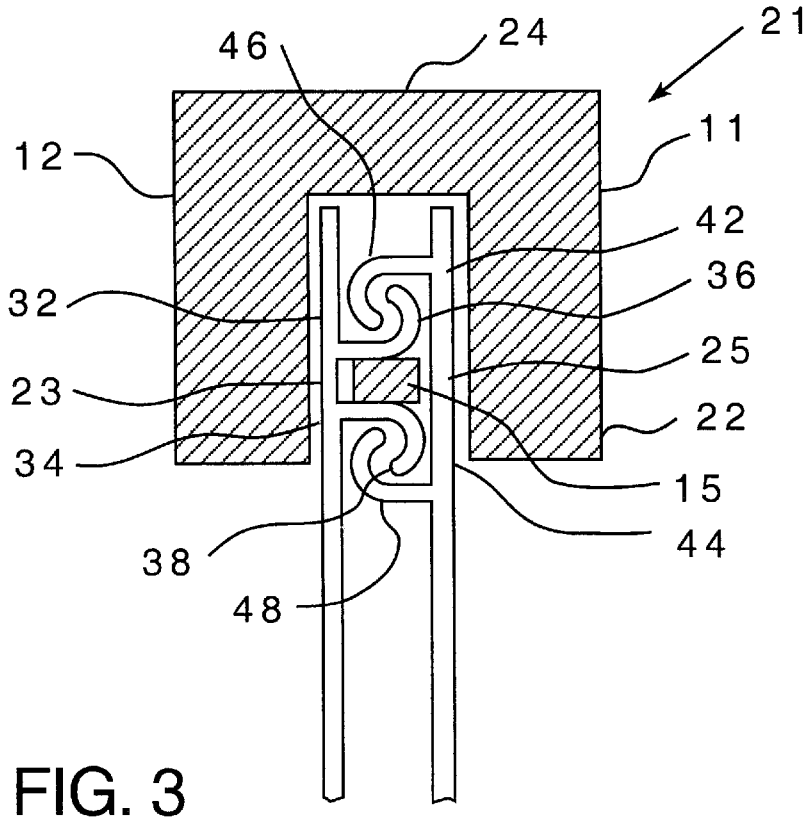
FIG. 3 is a fragmented, cross-sectional view of the closure mechanism of FIG. 2, taken along line 3—3 of FIG. 5.

FIGS. 2–3 further illustrate a closure mechanism 21 made in accordance with an embodiment of the present invention. The closure mechanism 21 includes first and second closure profiles 23, 25. The first closure profile 23 comprises a first base strip 32 with a first interlocking closure member 36 depending therefrom, and a second base strip 34 with a second interlocking closure member 38 depending therefrom. Likewise, the second closure profile 25 comprises a third base strip 42 with a third interlocking closure member 46 depending therefrom and a fourth base strip 44 with a fourth interlocking closure member 48 depending therefrom. The first and second interlocking closure members 36, 38 and the third and fourth interlocking closure members 46, 48 each extend a length from the first, second, third and fourth base strips 32, 34, 42, 44 sufficient for the first and third interlocking closure members 36, 46 and the second and fourth interlocking closure members 38, 48 to selectively engage, as shown in FIG. 3.

The package 20 shown in FIG. 1 further includes a slider 11 as illustrated further in FIGS. 2, 3, and 4*a*–4*d* which includes a top 24 and a pair of side walls 12, 22 extending from the top 24 such that the top 24 and the side walls 12, 22 form a generally C-shaped channel. The slider further includes a plow 14 comprising a substantially vertical member 13 extending or projecting from the top 24, and a substantially horizontal member 15 connected to the substantially vertical member 13 so as to form a generally inverted-T-shaped plow 14. As used herein, as well as in the claims, the terms "substantially vertical" and "substantially horizontal" describe the orientation of various slider components relative to the closure profiles 23, 25 or package 20, if the longitudinal axis of the closure profiles 23, 25 are regarded as horizontal.

Figure 4A:
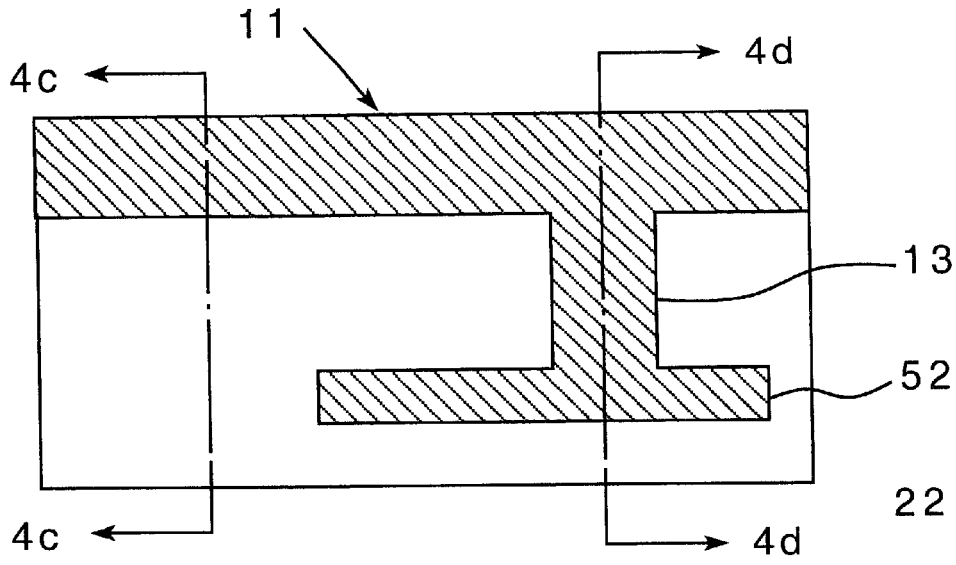
FIG. 4*a* is a cross-sectional view of a slider for use in connection with a closure mechanism in accordance with an embodiment of the present invention.
Figure 4B:
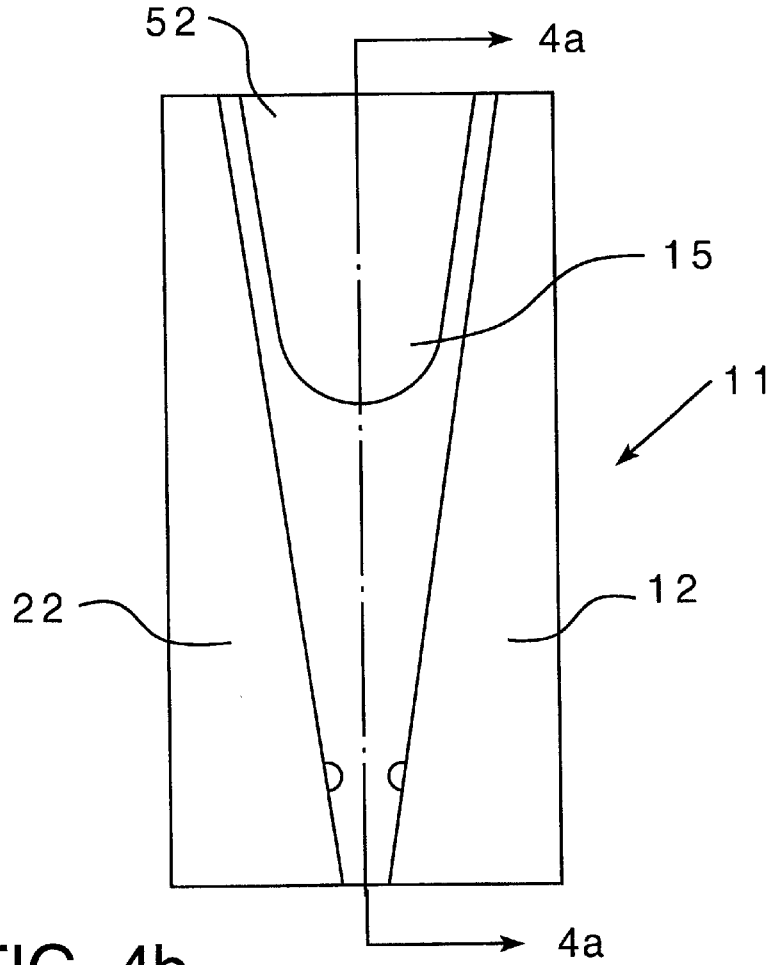
FIG. 4*b* is a bottom view of the slider shown in FIG. 4*a*.
Figure 4C:
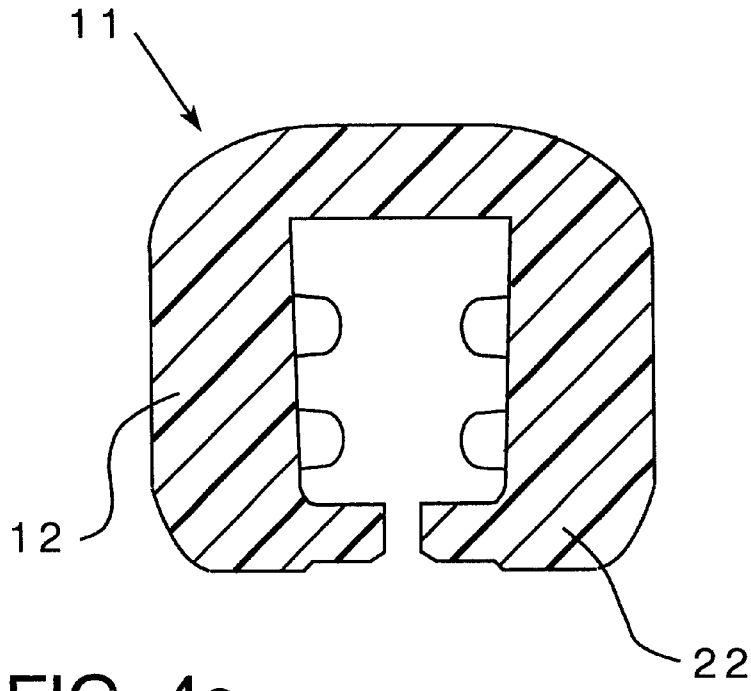
FIG. 4*c* is a cross-sectional view of the slider shown in FIG. 4*a* taken along line 4*c*—4*c*.
Figure 4D:
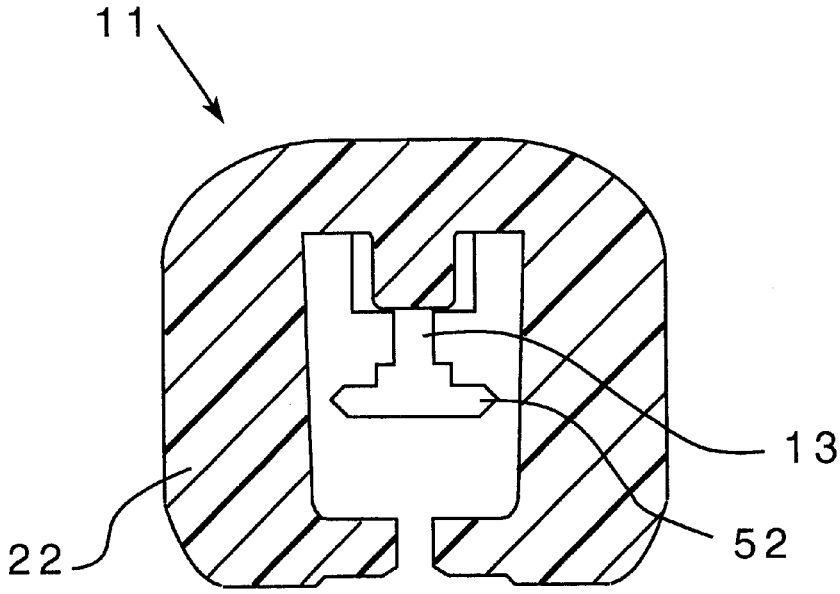
FIG. 4*d* is a cross-sectional view of the slider shown in FIG. 4*a* taken along line 4*d*—4*d*.

As illustrated in FIGS. 2 and 3, when the slider 11 is on the package 20, the substantially horizontal member 15 is disposed between the first interlocking member 36 and the second interlocking member 38. The substantially horizontal member 15 is also disposed between the third interlocking closure member 46 and the fourth interlocking closure member 48. The substantially horizontal member 15 is triangular in shape, as shown in FIG. 4*b*. The wide end 52 of the substantially horizontal member 15 is oriented such that as the slider 11 is moved in a direction from one end of the closure profiles 23, 25 to the other, while the interlocking closure members 36, 38, 46, 48 are engaged, as shown in FIG. 3, the wide end 52 will force the interlocking closure members 36, 38, 46, 48 to disengage, as shown in FIG. 2.

Figure 14:
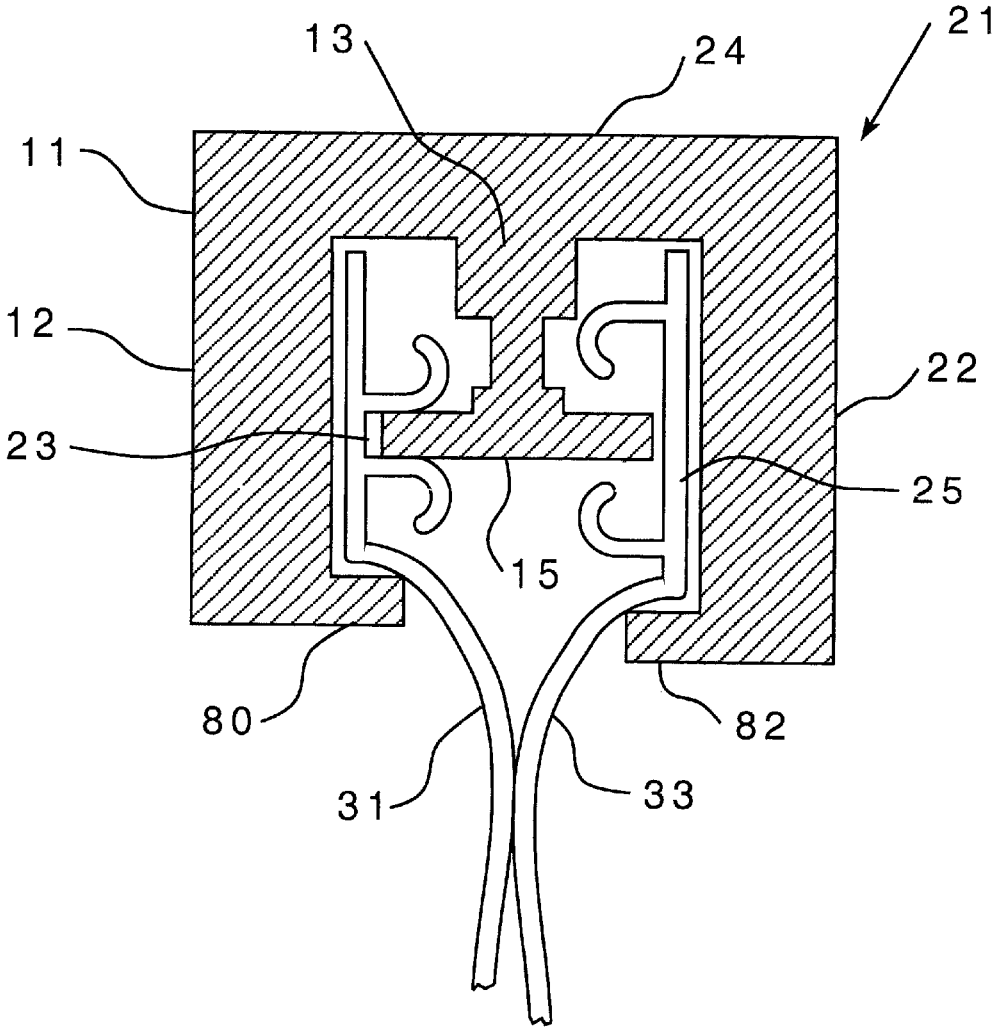
FIG. 14 is a cross-sectional view of an alternate embodiment of a closure mechanism of the present invention.

As illustrated in FIG. 2, the substantially horizontal member 15 is sized so as to fit between the interlocking closure members. The substantially horizontal member 15 is wide enough to extend at least partially underneath the first interlocking closure member 36 and the third interlocking closure member 46. As a result, substantially horizontal member 15 assists in holding the slider 11 onto the resealable bag 10. In an alternate embodiment, for example, as illustrated in FIG. 14, the slider 11 further includes two members 80, 82 that extend from the side walls 12, 22 toward each other. The members 80, 82 extend far enough from the side walls 12, 22 so as to push a portion of the first and second opposed panel sections 31, 33 at least partially underneath the first and second closure profiles 23, 25. The two members 80, 82 themselves extend at least partially underneath the first and second closure profiles 23, 25. In this way, the members 80, 82 assist in preventing the slider 11 from becoming removed from the resealable package 20.

Figure 5:
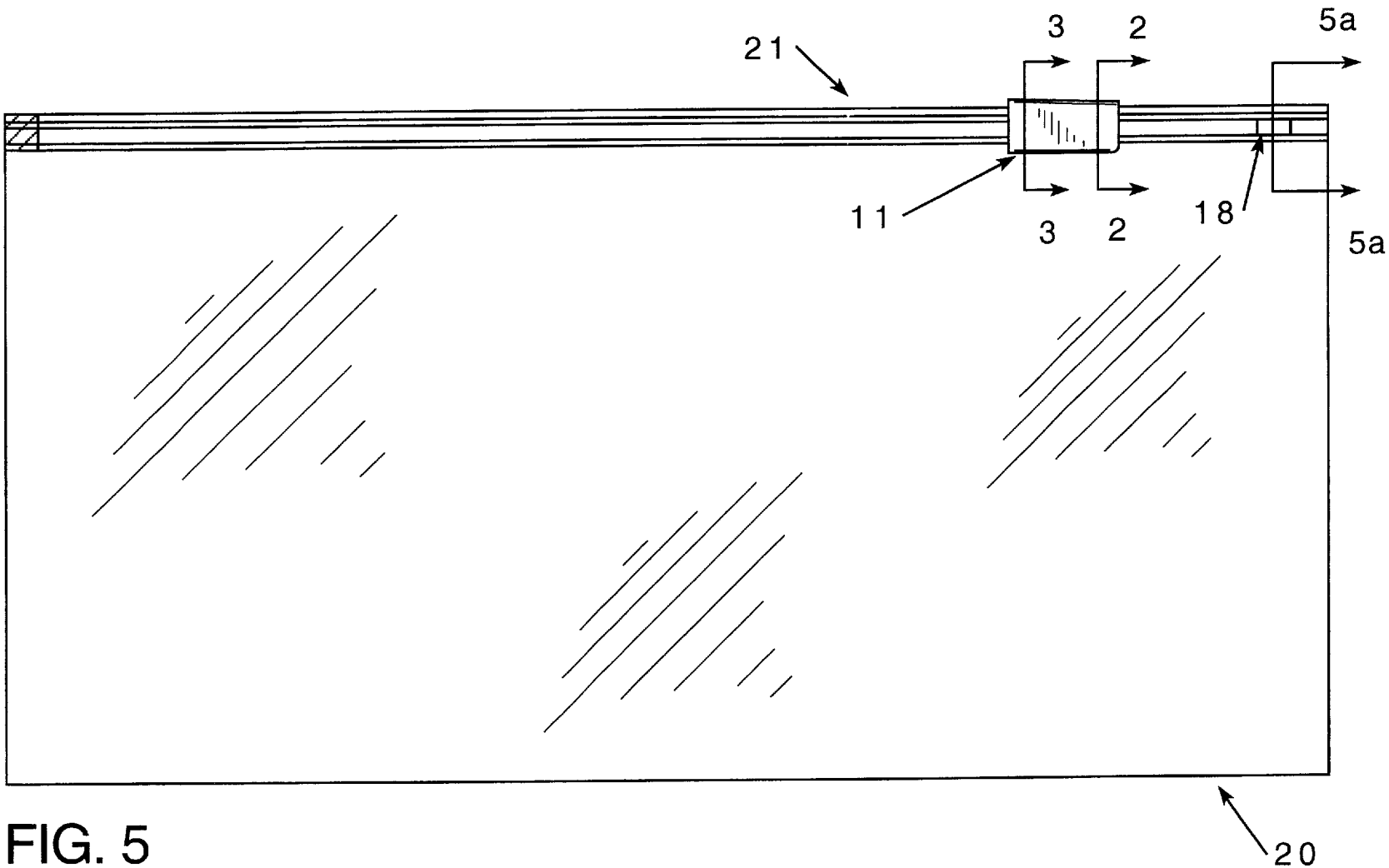
FIG. 5 is a side view of a resealable bag including a closure mechanism in accordance with an embodiment of the present invention.
Figure 5A:
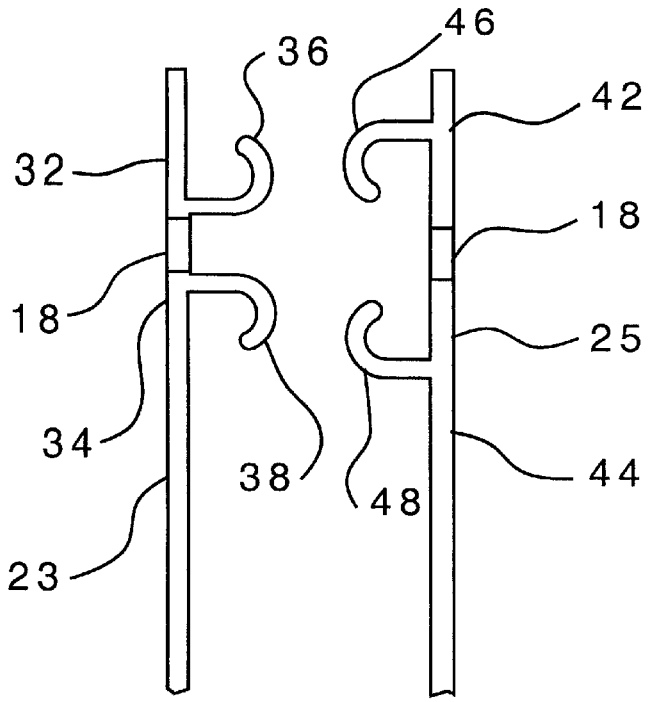
FIG. 5*a* is a cross-sectional view of the closure mechanism illustrated in FIG. 5, taken along line 5*a*—5*a*.
Figure 6:
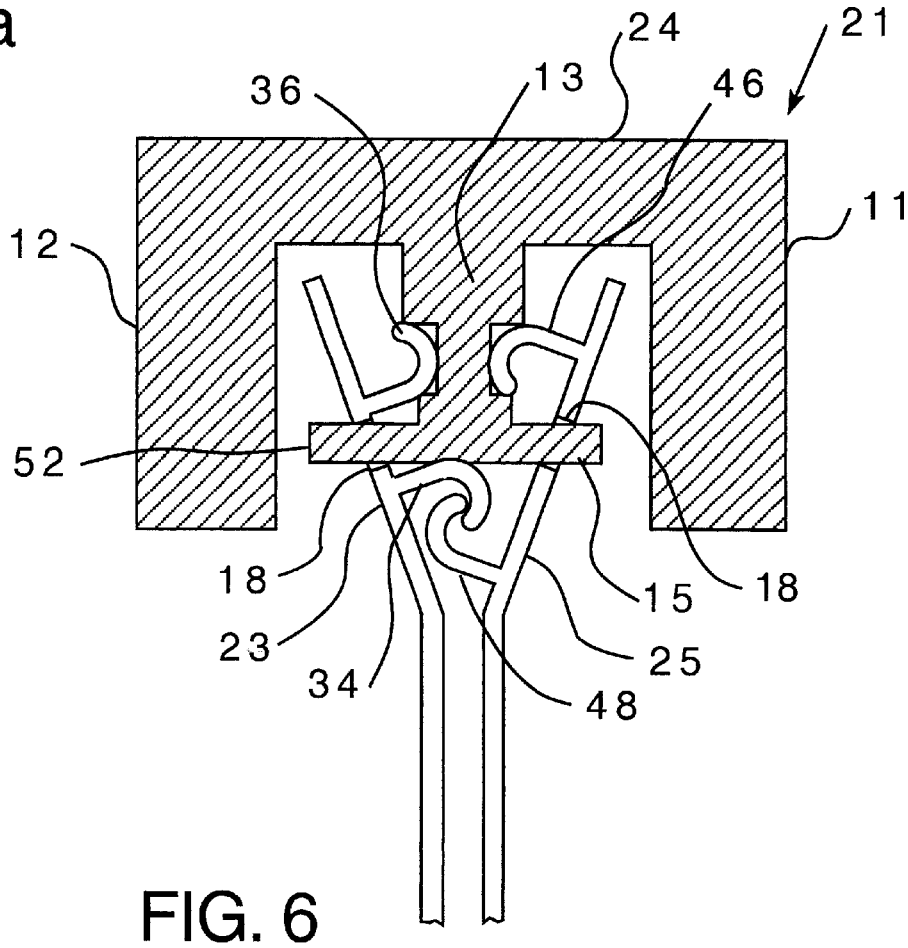
FIG. 6 is a fragmented, cross-sectional view of a closure mechanism in accordance with an embodiment of the present invention.

FIGS. 5*a* and 5 illustrate an alternate embodiment of the invention wherein the closure mechanism 21 further includes a punched-out section 18 is included and positioned between the first and second interlocking members 36, 38 and third and fourth interlocking members 46, 48. By "punched-out section," it is meant that a portion of the first and second closure profiles has been removed. The punched-out section 18 is located on one end of the resealable bag 20. The punched-out section 18 is located on the end that the slider 11 rests when the closure mechanism 21 is fully engaged. As shown in FIG. 6, the punched-out section 18 is sized to allow at least a portion of the wide end 52 of the substantially horizontal member 15 to pass through. In this way, when the slider 11 is moved fully to one end of the closure mechanism 21, and the wide end 52 of the substantially horizontal member 15 will not force the interlocking closure members 38, 48 to remain completely disengaged.

As further illustrated in FIG. 6, when a portion of the wide end 52 of the substantially horizontal member 15 passes through the punched-out section 18, the first and second closure profiles 23, 25 may be pushed together close enough to allow at least the second and fourth interlocking closure members 38, 48 to fully engage along their entire lengths. While a small segment of the first and third interlocking members 36, 46 may not fully engage due to the presence of the substantially horizontal member 15, the presence of the substantially horizontal member 15 above the second and fourth interlocking members 38, 48 will act to further leak-proof the package 20.

Figure 7:
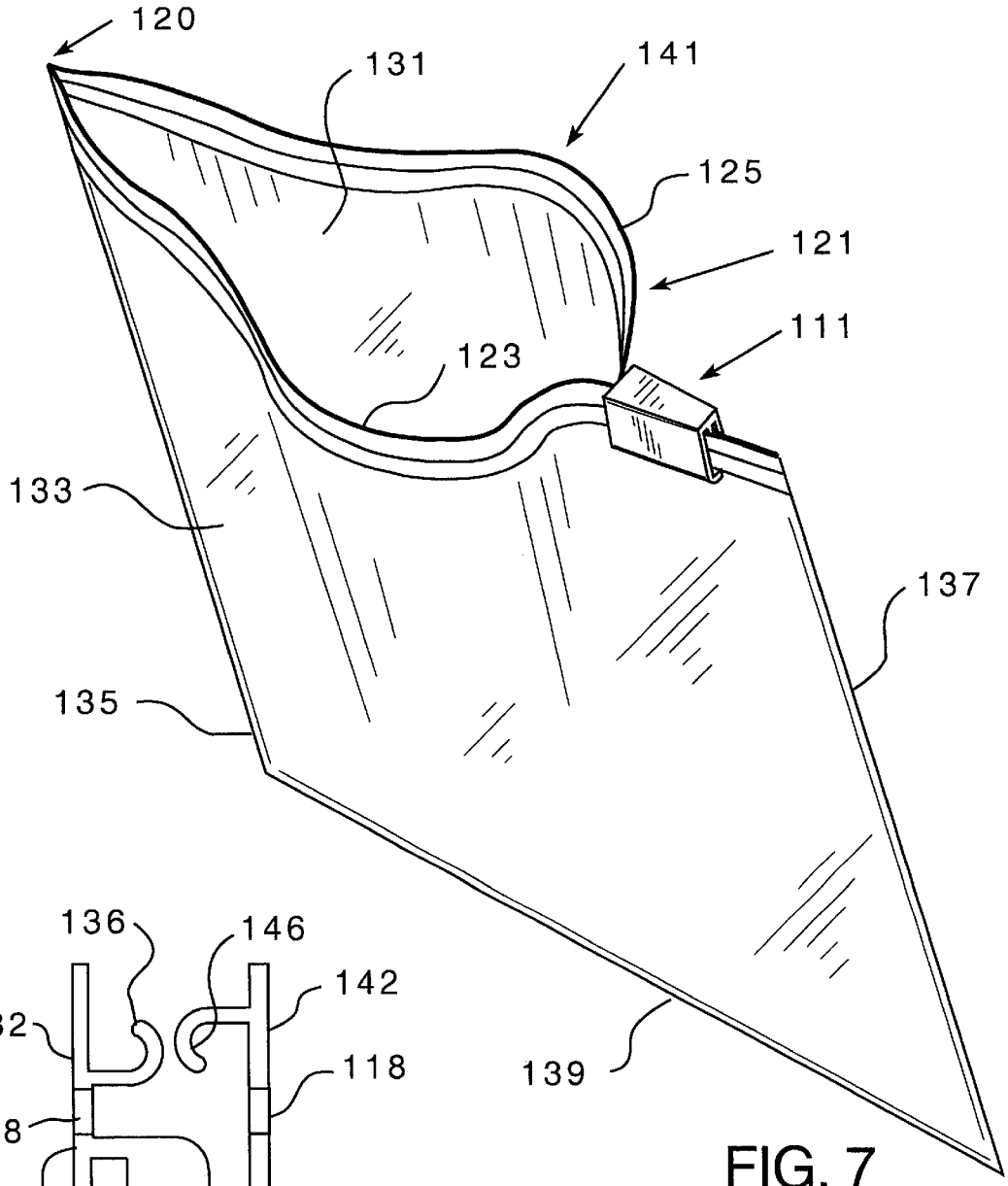
FIG. 7 is a perspective view of a flexible, resealable package in accordance with another embodiment of the present invention.

FIG. 7 illustrates a perspective view of a package 120 constructed according to principles of the present invention. The package 120 includes a closure mechanism 121 with first and second closure profiles 123, 125 and a slider device 11 and first and second opposed panel sections 131, 133 analogous to the corresponding structure depicted and described in conjunction with FIG. 1. The first and second opposed panel sections 131, 133 are sealed together along two edges 135, 137 and package 120 further comprises a bottom 139.

Figure 8:
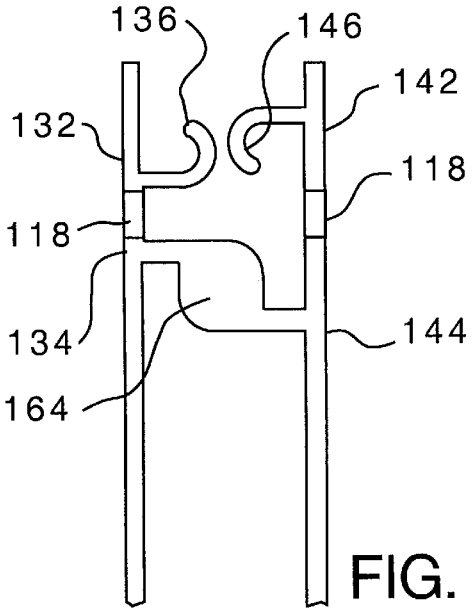
FIG. 8 is a cross-sectional view of the closure mechanism illustrated in FIG. 9, taken along line 8—8.
Figure 9:
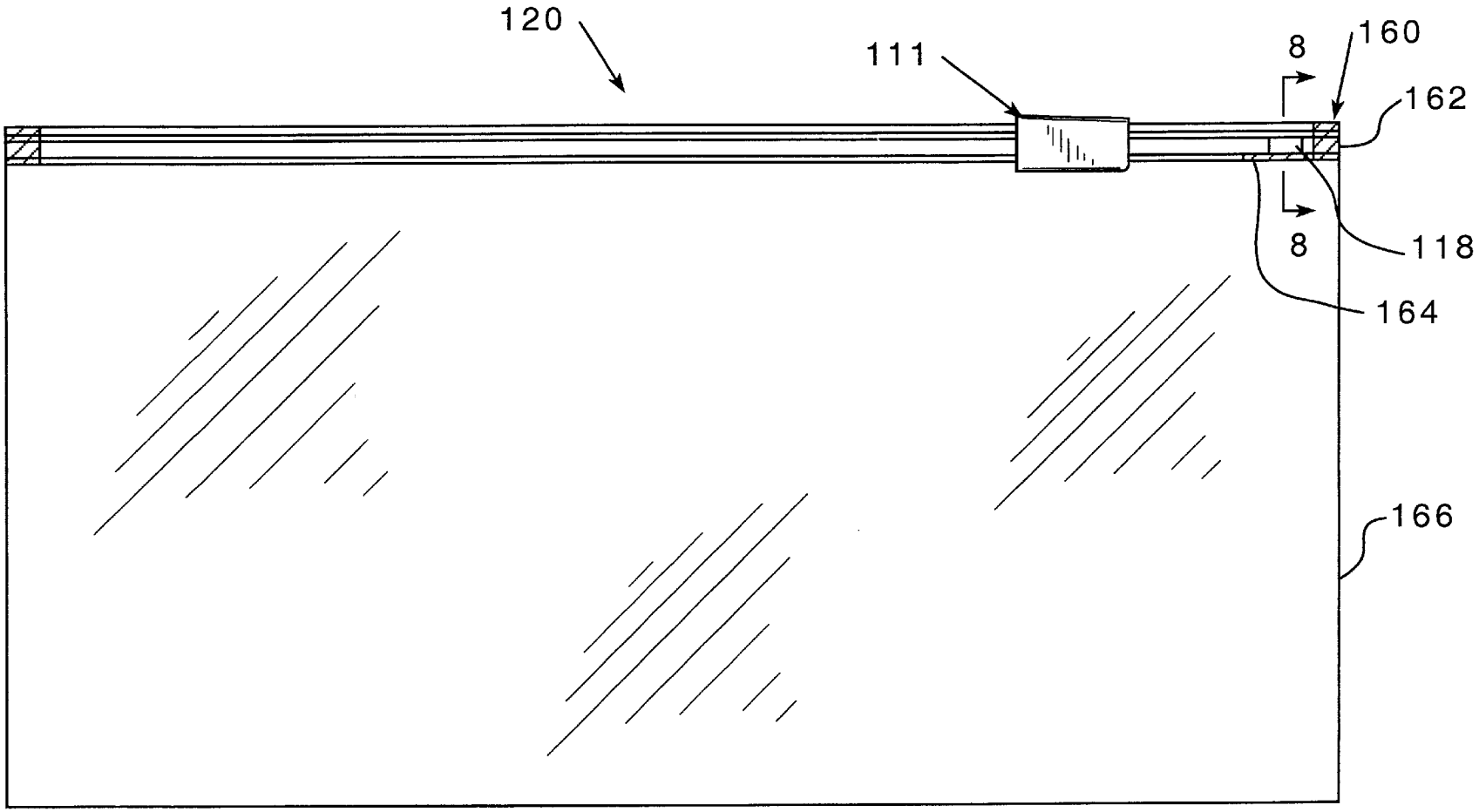
FIG. 9 is a side view of a resealable bag including a closure mechanism in accordance with an alternate embodiment of the present invention.

FIGS. 8–9 illustrate a portion of the package 120 and slider 111. A seal region is shown at 160 and is included to help leak-proof the package 120. The seal region 160 includes a first seal region 162 and a second seal region 164. The first seal region 162 acts to permanently secure together the first and second closure profiles 123, 125. By "permanently secure," it is meant that the first and second closure profiles 123, 125 are heat sealed or ultrasonically crushed together in a non-temporary manner such that the cannot be selectively disengaged and re-engaged. The first seal region 162 has a generally rectangular configuration and projects toward the remaining portions of the package 120 from side edge 166 some distance.

Attention is still directed to FIGS. 7–9. The second seal region 164 acts to permanently secure or seal together the second and fourth interlocking closure members 138, 148 (shown in FIG. 8) in a region underneath the punched-out section 118 (shown in FIG. 8). In this embodiment, the punched out section 118 may be included, or may be omitted. As can be best seen in FIG. 8, the second seal region 164 extends a length X from the edge 166 of the first seal region 162. The distance X can be any length which is suitable to help prevent leak-proof the package 120, but preferably is a length equal to the length of the slider 111. By extending underneath the punched-out section 118, the second seal region 164 helps ensure that product cannot escape through the punched-out section 118. Similar to the first seal region 162, the second seal region 164 may be formed by heat sealing or ultrasonic crushing.

Figure 10:
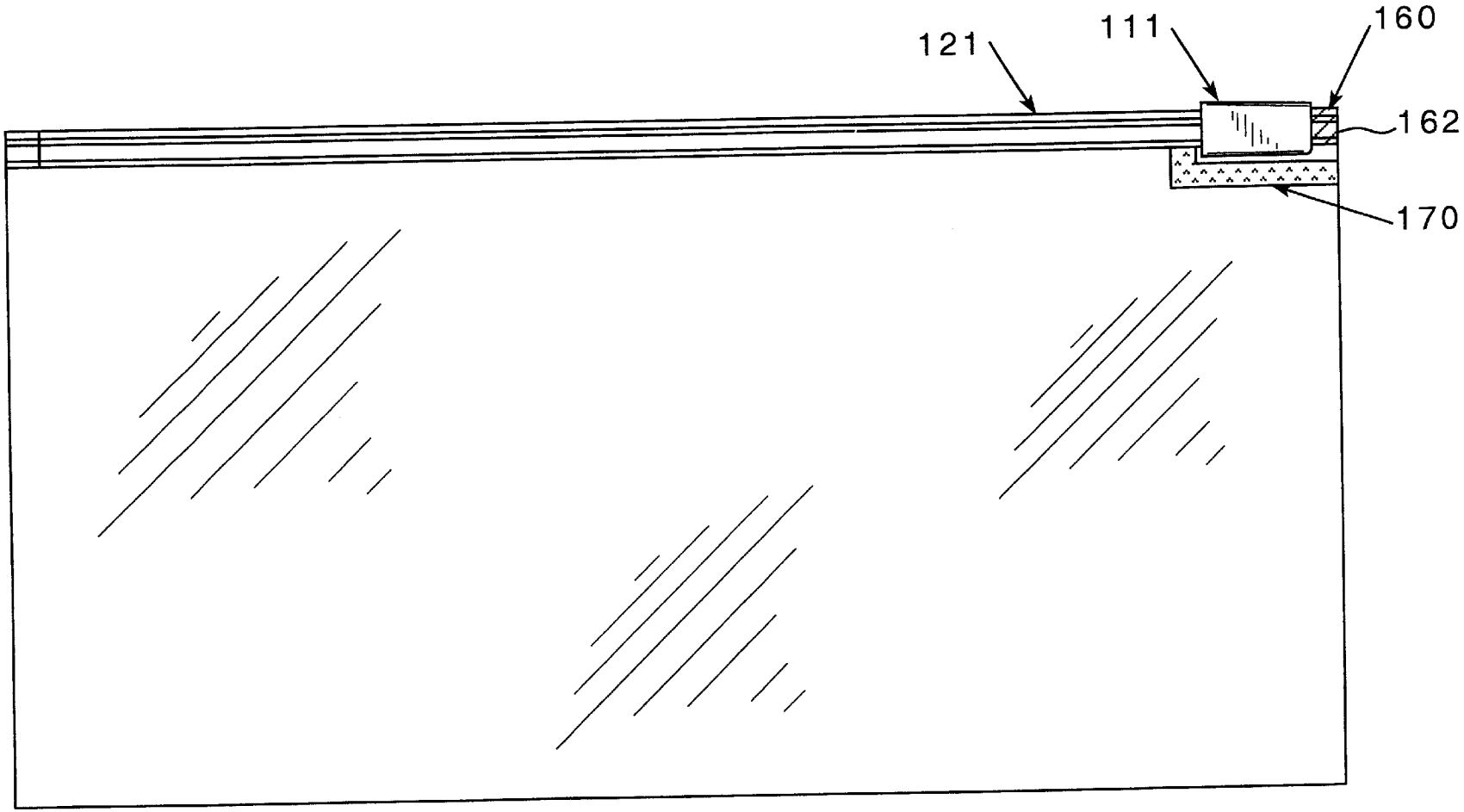
FIG. 10 is a side view of a resealable bag including a closure mechanism in accordance with an alternate embodiment of the present invention.

FIG. 10 illustrates an additional embodiment of the present invention in which the seal region 160 only includes the first seal region 162. The package 120 of this embodiment further includes a wall seal region 170 located underneath the punched out section 118 (as shown in FIG. 8). The wall seal region 170 acts to seal together the two opposed panel sections 131, 133 (as shown in FIG. 7) in an area adjacent to the closure mechanism 121. The wall seal region 170 may be any appropriate shape, for example, L-shaped as shown in FIG. 10, or square or rectangular. The wall seal region 170 is formed by heat sealing the opposed panel sections 131, 133 together, or by using a hot melt glue to seal the two opposed panel sections 131, 133 together.

Figure 11:
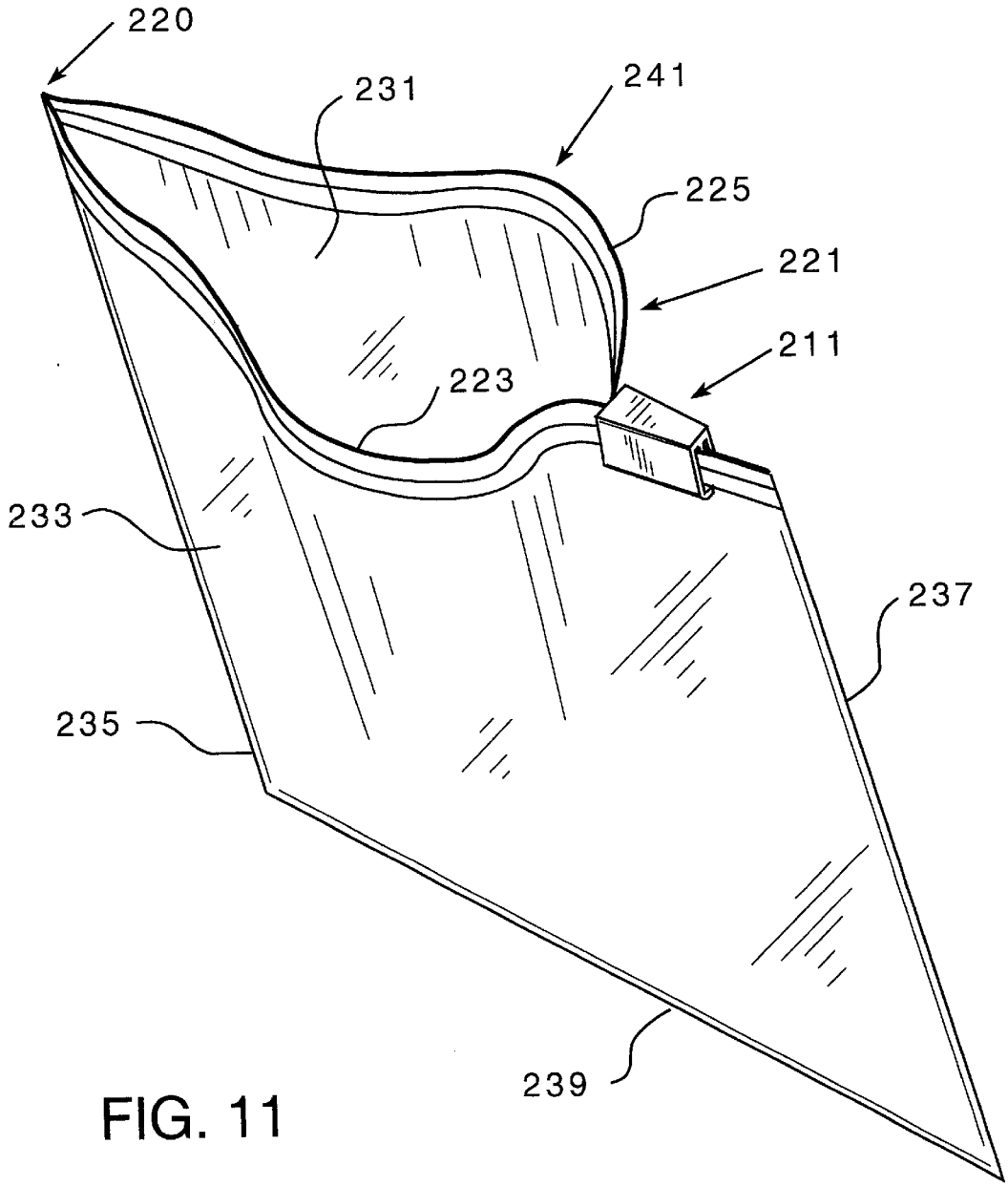
FIG. 11 is a perspective view of a flexible, resealable package in accordance with another embodiment of the present invention.
Figure 12:
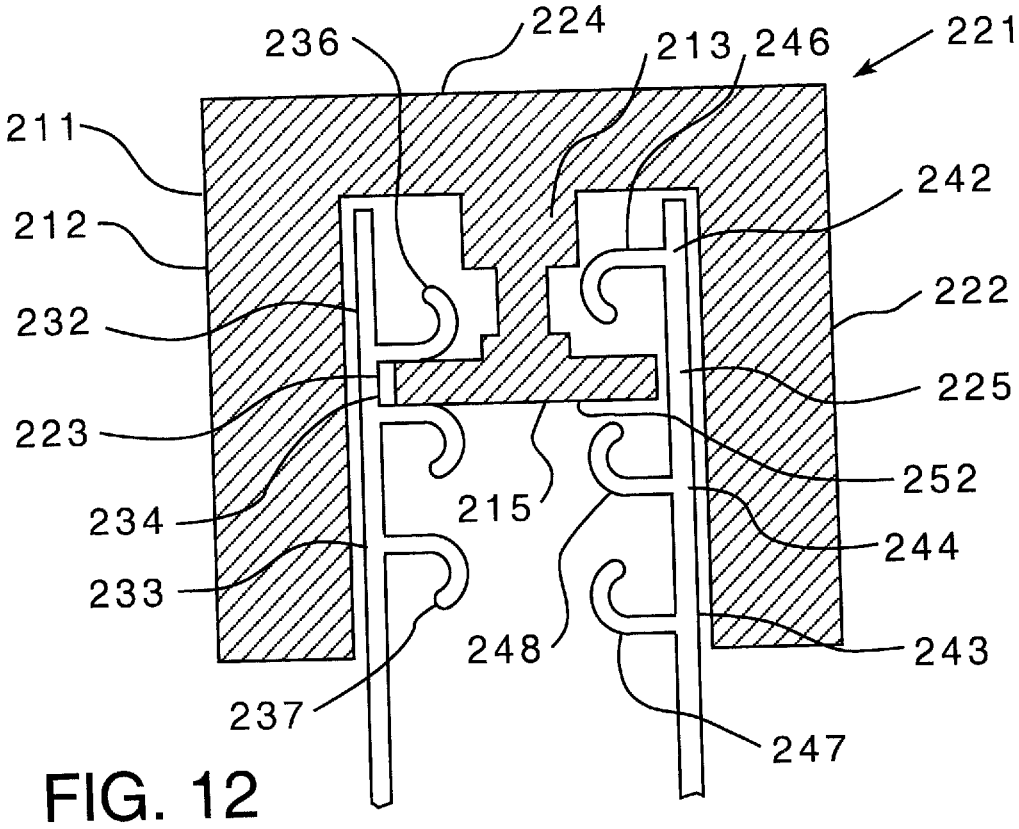
FIG. 12 is a fragmented, cross-sectional view of the closure mechanism of FIG. 10.
Figure 13:
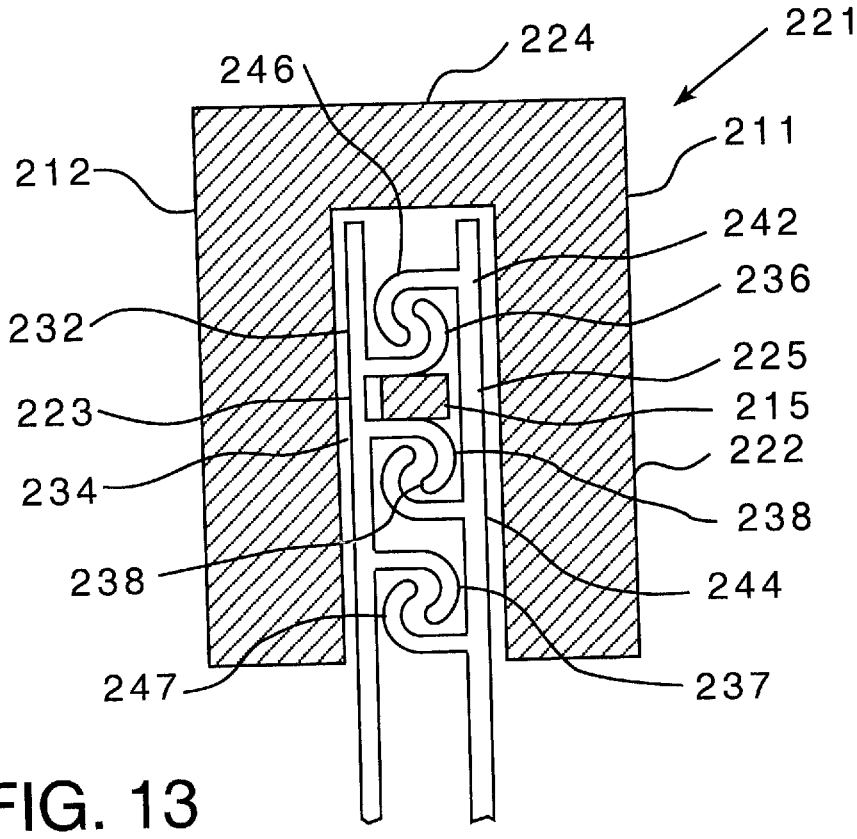
FIG. 13 is a fragmented, cross-sectional view of a closure of FIG. 12.

FIGS. 11–13 illustrate an additional embodiment of the present invention. FIG. 11 illustrates an example resealable flexible package 220 having a closure mechanism 221 with first and second closure profiles 223, 225 and a slider device 211 to open and close the profiles 223, 225. The flexible package 220 includes first and second opposed panel sections 231, 233 first and second opposed panel sections 131, 133 analogous to the corresponding structure previously depicted and described in conjunction with FIG. 1. The first and second opposed panel sections 231, 233 are sealed together along two edges 235, 237 and package 220 further comprises a bottom 239.

FIG. 12 further illustrates a closure mechanism 221 made in accordance with an embodiment of the present invention. The closure mechanism 221 includes first and second closure profiles 223, 225. The first closure profile 223 comprises a first base strip 232 with a first interlocking closure member 236 depending therefrom, a second base strip 234 with a second interlocking closure member 238 depending therefrom and a fifth base strip 233 with a fifth interlocking closure member 237 depending therefrom. Likewise, the second closure profile 225 comprises a third base strip 242 with a third interlocking closure member 246 depending therefrom, a fourth base strip 244 with a fourth interlocking closure member 248 depending therefrom and a sixth base strip 243 with a sixth interlocking closure member 247 depending therefrom. The first and second interlocking closure members 236, 238, the third and fourth interlocking closure members 246, 248, and the fifth and sixth interlocking closure members 237, 247 each extend a length from the first, second, third, fourth, fifth and sixth base strips 232, 234, 242, 244, 233, 243 sufficient for the first and third interlocking closure members 236, 246, the second and fourth interlocking closure members 238, 248 and the fifth and sixth interlocking closure members 237, 247 to selectively engage, as shown in FIG. 13.

As previously illustrated in FIGS. 2 and 3 and as is preferable and shown in FIGS. 11–13, when the slider 211 is in position on the package 220, the substantially horizontal member 215 is disposed between the first interlocking closure member 236 and the second interlocking closure member 238. The substantially horizontal member 215 is also disposed between the third interlocking closure member 246 and the fourth interlocking closure member 248. The wide end 252 of the substantially horizontal member 215 is oriented such that as the slider 211 is moved in a direction from one end of the closure profiles 223, 225 to the other, while the interlocking closure members 236, 238, 246, 248, 237, 247 are engaged, as shown in FIG. 13, the wide end 252 will force the interlocking closure members 236, 238, 246, 248, 237, 247 to disengage, as shown in FIG. 12. The fifth and sixth interlocking closure members 237, 247 are provided in certain embodiments to add another level of security in an effort to make the package 220 leak-proof.

While specific embodiments and methods for practicing this invention have been described in detail, those skilled in the art will recognize various manifestations and details that could be developed in light of the overall teachings herein. Accordingly, the particular mechanisms disclosed are meant to be illustrative only and not to limit the scope of the invention which is to be given the full breadth of the following claims and any and all embodiments thereof.

What is claimed is:

1. A resealable flexible package comprising:

(a) first and second panel sections joined together to define an enclosed region, first and second opposite side edges, a bottom and a mouth that provides access to the enclosed region;

(b) a leak-proof closure mechanism comprising first and second closure profiles;

(i) the first closure profile having first and second base strips, the first base strip having a first interlocking member extending therefrom and the second base strip having a second interlocking member extending therefrom;

(ii) the second closure profile having third and fourth base strips, the third base strip having a third interlocking member extending therefrom and the fourth base strip having a fourth interlocking member extending therefrom;

(iii) the first and third interlocking members constructed and arranged to selectively interlock;

(iv) the second and fourth interlocking members constructed and arranged to selectively interlock;

(c) a slider device having a length, and having first and second walls and a top that define a first cavity for receiving the first and second closure profiles, the slider device arranged and constructed to slide along the first and second closure profiles in a first direction to cause the first and second closure profiles to engage;

(i) the slider device further comprises a plow comprising a substantially vertical member depending from the top of the slider and a substantially horizontal member that is connected to the substantially vertical member, the horizontal member being configured to separate the first and second closure profiles as the slider device moves in a second direction; and (ii) the substantially horizontal member is disposed between the first and second interlocking closure members formed on the first closure profile and between the third and fourth interlocking closure members formed on the second closure profile.

2. The package of claim 1, wherein the substantially horizontal member is triangular in shape.

3. The package of claim 2, further comprising a punched-out section at one end of the first and second closure profiles, the punched-out section disposed between the first and second interlocking closure members and between the third and fourth interlocking closure members.

4. The package of claim 3, wherein the substantially horizontal member has a wide end and a narrow end, and said horizontal member is constructed and arranged such that when the slider is moved to the end of the closure profiles having the punched-out section, the wide end extends at least partially through the punched out section.

5. The package of claim 1, further comprising a first seal region, the first seal region permanently securing together the first and third interlocking closure members and permanently securing together the second and fourth interlocking closure members, the first seal region extending from a side edge of the package.

6. The package of claim 5, further comprising a second seal region, the second seal region permanently securing together the second and fourth interlocking closure members, the second seal region extending a length from the termination of the first seal region.

7. The package of claim 6, wherein the length of the second seal region is approximately equal to the length of the slider.

8. The package of claim 5, further comprising a wall seal region, the wall seal region permanently securing together the first and second panel sections, the wall seal region extending from a side edge of the package.

9. The package of claim 1, wherein (1) the first closure profile further comprises a fifth base strip having a fifth interlocking closure member extending therefrom;

(2) the second closure profile further comprises a sixth base strip having a sixth interlocking closure member extending therefrom; and (3) the fifth and sixth interlocking closure members constructed and arranged to selectively interlock.

10. A closure mechanism comprising (a) first and second closure profiles;

(i) the first closure profile having first and second base strips, the first base strip having a first interlocking member extending therefrom and the second base strip having a second interlocking member extending therefrom;

(ii) the second closure profile having third and fourth base strips, the third base strip having a third interlocking member extending therefrom and the fourth base strip having a fourth interlocking member extending therefrom;

(iii) the first and third interlocking members constructed and arranged to selectively interlock;

(iv) the second and fourth interlocking members constructed and arranged to selectively interlock;

(b) a slider device having a length, and having first and second walls and a top that define a first cavity for receiving the first and second closure profiles, the slider device arranged and constructed to slide along the first and second closure profiles in a first direction to cause the first and second closure profiles to engage;

(i) the slider device further comprises a plow comprising a substantially vertical member depending from the top of the slider and a substantially horizontal member that is connected to the substantially vertical member, the horizontal member being configured to separate the first and second closure profiles as the slider device moves in a second direction; and (ii) the substantially horizontal member is disposed between the first and second interlocking closure members formed on the first closure profile and between the third and fourth interlocking closure members formed on the second closure profile.

11. The closure mechanism of claim 10, wherein the substantially horizontal member is triangular in shape.

12. The closure mechanism of claim 11, further comprising a punched-out section at one end of the first and second closure profiles, the punched-out section disposed between the first and second interlocking closure members and between the third and fourth interlocking closure members.

13. The closure mechanism of claim 12, wherein the substantially horizontal member has a wide end and a narrow end, and said horizontal member is constructed and arranged such that when the slider is moved to the end of the closure profiles having the punched-out section, the wide end extends at least partially through the punched out section.

14. The closure mechanism of claim 10, further comprising a first seal region, the first seal region permanently securing together the first and third interlocking closure members and permanently securing together the second and fourth interlocking closure members, the first seal region extending from a side edge of the package.

15. The closure mechanism of claim 14, further comprising a second seal region, the second seal region permanently securing together the second and fourth interlocking closure members, the second seal region extending a length from the termination of the first seal region.

16. The closure mechanism of claim 15, wherein the length of the second seal region is approximately equal to the length of the slider.

17. The closure mechanism of claim 14, further comprising a third seal region, the third seal region permanently securing together the first and third interlocking closure members, the third seal region extending a length from the termination of the first seal region.

18. The closure mechanism of claim 17, wherein the length of the third seal region is approximately equal to the length of the slider.

19. The closure mechanism of claim 10, wherein the first closure profile further comprises a fifth base strip having a fifth interlocking closure member extending therefrom;

the second closure profile further comprises a sixth base strip having a sixth interlocking closure member extending therefrom; and the fifth and sixth interlocking closure members constructed and arranged to selectively interlock.

* * * * *